US009255502B1

(12) United States Patent
Glass

(10) Patent No.: US 9,255,502 B1
(45) Date of Patent: Feb. 9, 2016

(54) ENGINE WITH EXHAUST SYSTEM AND EXTERNAL ACOUSTIC EMISSIONS VALVE

(71) Applicant: Dean W. Glass, Carlton, OR (US)

(72) Inventor: Dean W. Glass, Carlton, OR (US)

(73) Assignee: NORTHWEST ULD, INC., McMinnville, OR (US)

( * ) Notice: Subject to any disclaimer, the term of this patent is extended or adjusted under 35 U.S.C. 154(b) by 0 days.

(21) Appl. No.: 14/461,214

(22) Filed: Aug. 15, 2014

Related U.S. Application Data

(60) Provisional application No. 61/866,312, filed on Aug. 15, 2013.

(51) Int. Cl.
*F02B 75/28* (2006.01)
*F01N 1/18* (2006.01)

(52) U.S. Cl.
CPC ..... *F01N 1/18* (2013.01)

(58) Field of Classification Search
CPC ..... F02B 2075/025; F02B 2075/1808; F02B 77/13; F02B 27/04; F02M 35/10262; F02M 35/1244; F02M 35/1272; F02M 35/1294; F02M 35/16
USPC ..... 123/51 B, 51 A, 51 BA, 51 BB, 51 BC, 123/51 BD; 60/289, 272, 324; 244/53 A
See application file for complete search history.

(56) References Cited

U.S. PATENT DOCUMENTS

| | | | | |
|---|---|---|---|---|
| 2,320,668 | A | 6/1943 | Smith | |
| 3,066,755 | A | 12/1962 | Diehl | |
| 3,692,142 | A | 9/1972 | Stemp | |
| 3,744,589 | A | 7/1973 | Mellin | |
| 3,927,731 | A | 12/1975 | Lancaster | |
| 4,579,195 | A | 4/1986 | Nieri | |
| 5,612,006 | A | 3/1997 | Fisk | |
| 6,684,633 | B2 | 2/2004 | Jett | |
| 6,959,782 | B2 | 11/2005 | Brower et al. | |
| 7,472,774 | B1 | 1/2009 | Monson et al. | |
| 7,721,845 | B2 | 5/2010 | Gorenflo | |
| 8,602,159 | B2 | 12/2013 | Harris et al. | |
| 2005/0023078 | A1 | 2/2005 | Brower et al. | |
| 2006/0156711 | A1 * | 7/2006 | Carpenter | F01N 3/22 60/289 |
| 2011/0180347 | A1 | 7/2011 | Butler | |

* cited by examiner

*Primary Examiner* — Lindsay Low
*Assistant Examiner* — Long T Tran
(74) *Attorney, Agent, or Firm* — Marsh Fischmann & Breyfogle LLP

(57) ABSTRACT

An engine with an acoustic emissions valve or reflector for an exhaust system is disclosed. This reflector is disposed outside of the exhaust system—the reflector is disposed in the atmosphere into which the exhaust system discharges. The reflector is moved between a reflecting position (where the reflector reflects or obstructs acoustic emissions from the exhaust system) and a non-reflecting position (where the reflector does not obstruct the bulk exhaust gas flow from the exhaust system) by rotation of the crankshaft.

20 Claims, 15 Drawing Sheets

ENGINE WITH EXHAUST SYSTEM AND EXTERNAL ACOUSTIC EMISSIONS VALVE

CROSS-REFERENCE TO RELATED APPLICATIONS

This patent application is a non-provisional patent application of and claims priority to U.S. Provisional Patent Application Ser. No. 61/866,312, that is entitled "CRANKSHAFT TIMED REFLECTOR," that was filed on Aug. 15, 2013, and the entire disclosure of which is hereby incorporated by reference in its entirety herein.

FIELD OF THE INVENTION

The present invention generally relates to the field of engines and, more particularly, to the addressing acoustic emissions generated by operation of the engine.

BACKGROUND

Mufflers, silencers, expansion chambers, and similar acoustic mitigation devices utilize wave principles of energy dispersion, absorption, and wave interaction to modify the acoustic wave ultimately exiting these devices. There remains a need for at least some applications to further modify the acoustic signature provided by these types of devices, preferably without modifying either the associated engine or an existing muffler.

SUMMARY

A first aspect of the invention is directed to an engine (e.g., two cycle) that includes a first cylinder, a first piston that is disposed within this first cylinder, a crankshaft that is interconnected with this first piston, an exhaust system that is fluidly connected with the first cylinder and that includes an exhaust discharge port, and a reflector. The reflector extends from and is rotated by the crankshaft, and the reflector is positioned within the atmosphere—the reflector is not internal to the exhaust system. The reflector is disposable into alignment with and completely out of alignment with the exhaust discharge port (e.g., a port that discharges from the exhaust system to atmosphere) by rotation of the crankshaft.

DETAILED DESCRIPTION

Figure 1:
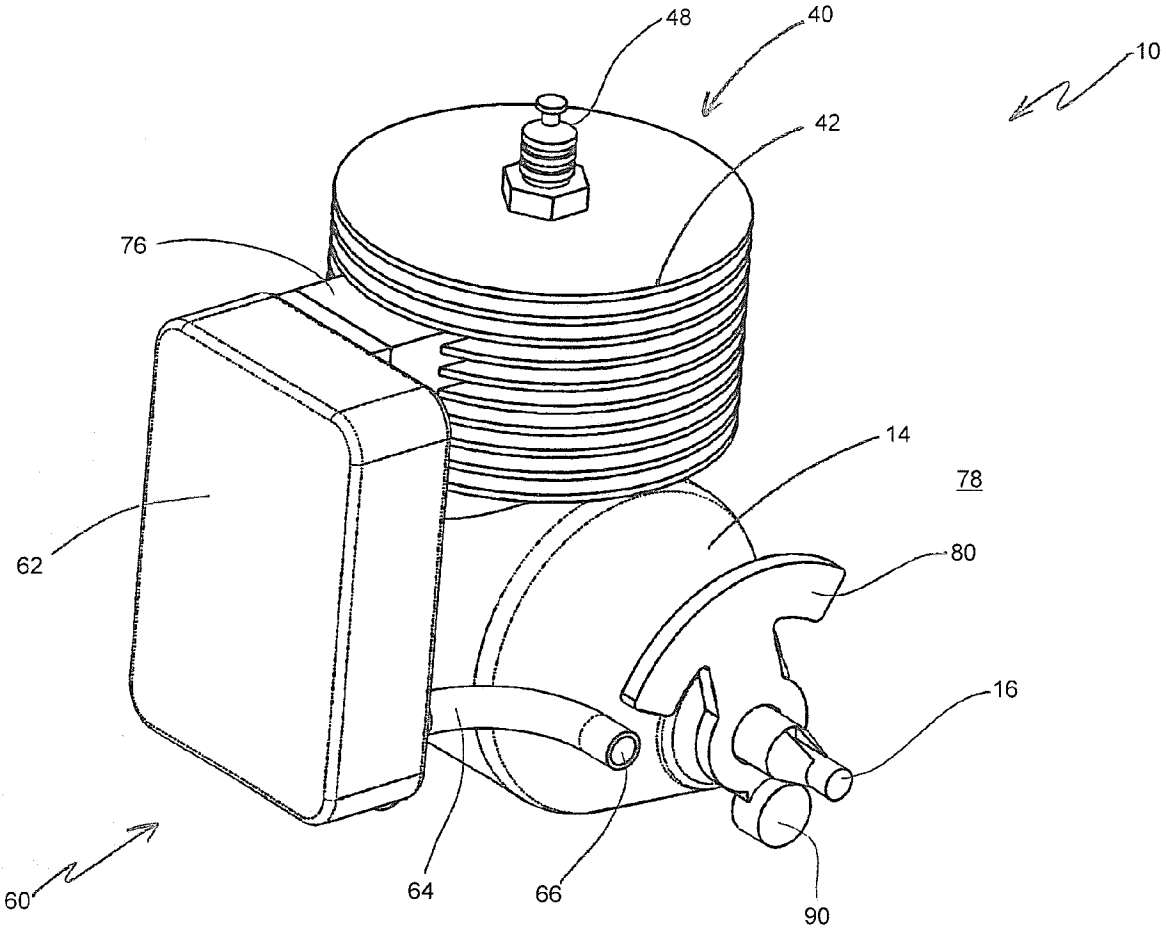
FIG. 1 is a perspective view of one embodiment of an engine with an exhaust system reflector, with the exhaust system reflector being in a non-reflecting position for acoustic emissions discharged from the exhaust system.

FIGS. 1-7 present various views of one embodiment of an engine 10. The engine 10 includes a crankshaft 16, an engine case 14, a cylinder 40 (which may include one or more cooling fins 42 for moving heat generated during operation of the engine 10), a spark plug or other igniter 48, an exhaust system 60, an exhaust system reflector 80 located downstream of the exhaust system 60, and a counterweight 90. One or more engine mounts 12 may be utilized for securing the engine 10 relative to a vehicle of any appropriate type, such as an unmanned aerial vehicle. Rotation of the crankshaft 16 may rotate a propeller (in the case of an aerial vehicle), may rotate an axle and each associated wheel (in the case of a ground vehicle), or the like.

The exhaust system 60 for the engine 10 includes a muffler 62 that receives a discharge or exhaust/exhaust flow from the cylinder 40 during operation of the engine 10 and via an exhaust header 76 that fluidly interconnects the cylinder 40 and the muffler 62. The muffler 62 may be of any appropriate size, shape, configuration, and/or type. An exhaust conduit 64 (e.g., a tailpipe or stinger) extends from the muffler 62 and includes an open end or exhaust discharge port 66. As such, exhaust from the cylinder 40 flows into/through the header 76, then into/through the muffler 62, and then into/through the exhaust conduit 64 such that the exhaust exits through the open end 66 of the exhaust conduit 64.

The exhaust flowing out of the exhaust system 60 through the open end 66 of the exhaust conduit 64 may be characterized as including two primary components—a bulk exhaust gas flow and acoustic emissions (e.g., one or more acoustic waves). The exhaust system reflector 80 is used by the engine 10 to force at least a part of the acoustic emissions (after having exited the exhaust system 60 through the open end 66 of the exhaust conduit 64, or at least after having reached the open end 66 of the exhaust conduit 64 (FIG. 8C)) back into the exhaust conduit 64 (via its open end 66) and preferably then back into the muffler 62. This reflection and/or obstruction of at least part of the acoustic emissions should dampen the acoustic emissions (e.g., further lower the acoustic emissions from operation of the engine 10; accommodate additional acoustic wave destructive interference) more than if the acoustic emissions make a single pass through the muffler 62 in proceeding from the cylinder 40 to the exhaust conduit 64. In addition to the foregoing, the reflector 80 should also be sized and timed (relative to the position of the open end 66 of the exhaust conduit 64) to reduce the potential of an unacceptable amount of the bulk exhaust gas flow being redirected or obstructed by the reflector 80, which could generate a back pressure in the muffler 62 and the cylinder 40, which in turn could adversely affect the operational performance of the engine 10. Preferably no portion of the bulk exhaust gas flow is reflected or obstructed by the exhaust system reflector 80 at any time. As such, the reflector 80 may also be referred to as an acoustic emissions valve 80 that is positioned downstream of the exhaust system 60. Such an acoustic emissions valve 80 may be moved into a position (by the crankshaft 16) so as to reflect or obstruct acoustic emissions, but may be moved out of this position (by the crankshaft 16) so as to not obstruct the bulk exhaust gas flow that has exited the exhaust system 60.

The exhaust system reflector 80 may be integrated with the crankshaft 16 in any appropriate manner so that the exhaust system reflector 80 and the crankshaft 16 rotate in unison—the reflector 80 will rotate 360° each time that the crankshaft 16 rotates 360°. The reflector 80 could be separately attached to the crankshaft 16 in any appropriate manner, the reflector 80 could actually be part of the crankshaft 16, or the like. The counterweight 90 may also be incorporated by the crankshaft 16 in any appropriate manner so that the counterweight 90 and the crankshaft 16 also rotate in unison—the counterweight 90 will rotate 360° each time that the crankshaft 16 rotates 360°. The counterweight 90 could be separately attached to the crankshaft 16 in any appropriate manner, the counterweight 90 could actually be part of the crankshaft 16, or the like. In the illustrated embodiment, the counterweight 90 is mounted 180° from the reflector 80 relative to a rotational axis of the crankshaft 16 (e.g., the counterweight 90 and reflector 80 are disposed in opposing relation relative to the crankshaft 16). The counterweight 90 functions to maintain an appropriate rotational balance for the crankshaft 16. Other configurations where rotation of the crankshaft 16 moves the reflector 80 in the manner to be described herein may be utilized by the engine 10.

The reflector 80 is located outside of the exhaust system 60. The exhaust system 60 discharges to the atmosphere 78. As such, the reflector 80 is located within the atmosphere 78. In order to reflect at least part of the acoustic emissions back into the exhaust system 60, but to not reflect any substantial portion of the bulk exhaust gas flow back into the exhaust system 60, the reflector 80 is rotated into and out of alignment with the open end 66 of the exhaust conduit 64 through rotation of the crankshaft 16. "In alignment" in relation to the relative positioning of the reflector 80 and the open end 66 of the exhaust conduit 64 means that at least part the flow out of the open end 66 of the exhaust conduit 64 impacts the reflector 80 in a manner that reflects at least part of this flow back into the exhaust system 60 (where this flow is in the form of acoustic emissions in this instance). "Out of alignment" in relation to the relative positioning of the reflector 80 and the open end 66 of the exhaust conduit 64 means that the flow out of the open end 66 of the exhaust conduit 64 does not impact the reflector 80 in a manner that obstructs flow out of the exhaust system 60 (where this flow is in the form of the bulk exhaust gas flow in this instance). It should be appreciated that in certain instances the reflector 80 will be blocking/reflecting only a portion of the flow exiting the exhaust system 60 (e.g., as the reflector 80 is being rotated into alignment with the open end 66 of the exhaust conduit 84, and where the flow in this instance is in the form of acoustic emissions).

Figure 2:
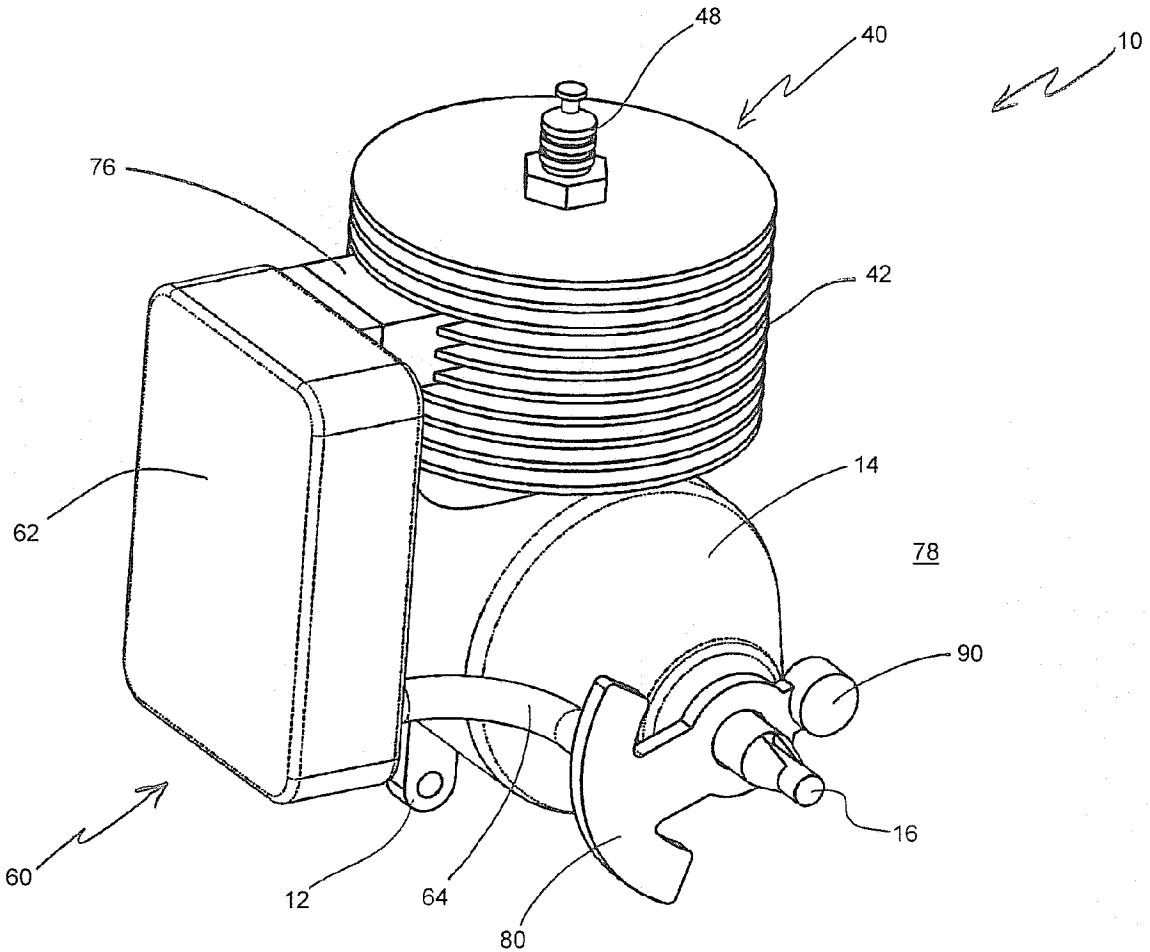
FIG. 2 is another perspective view of the engine of FIG. 1, with the exhaust system reflector being in a reflecting position for acoustic emissions discharged from the exhaust system.
Figure 3:
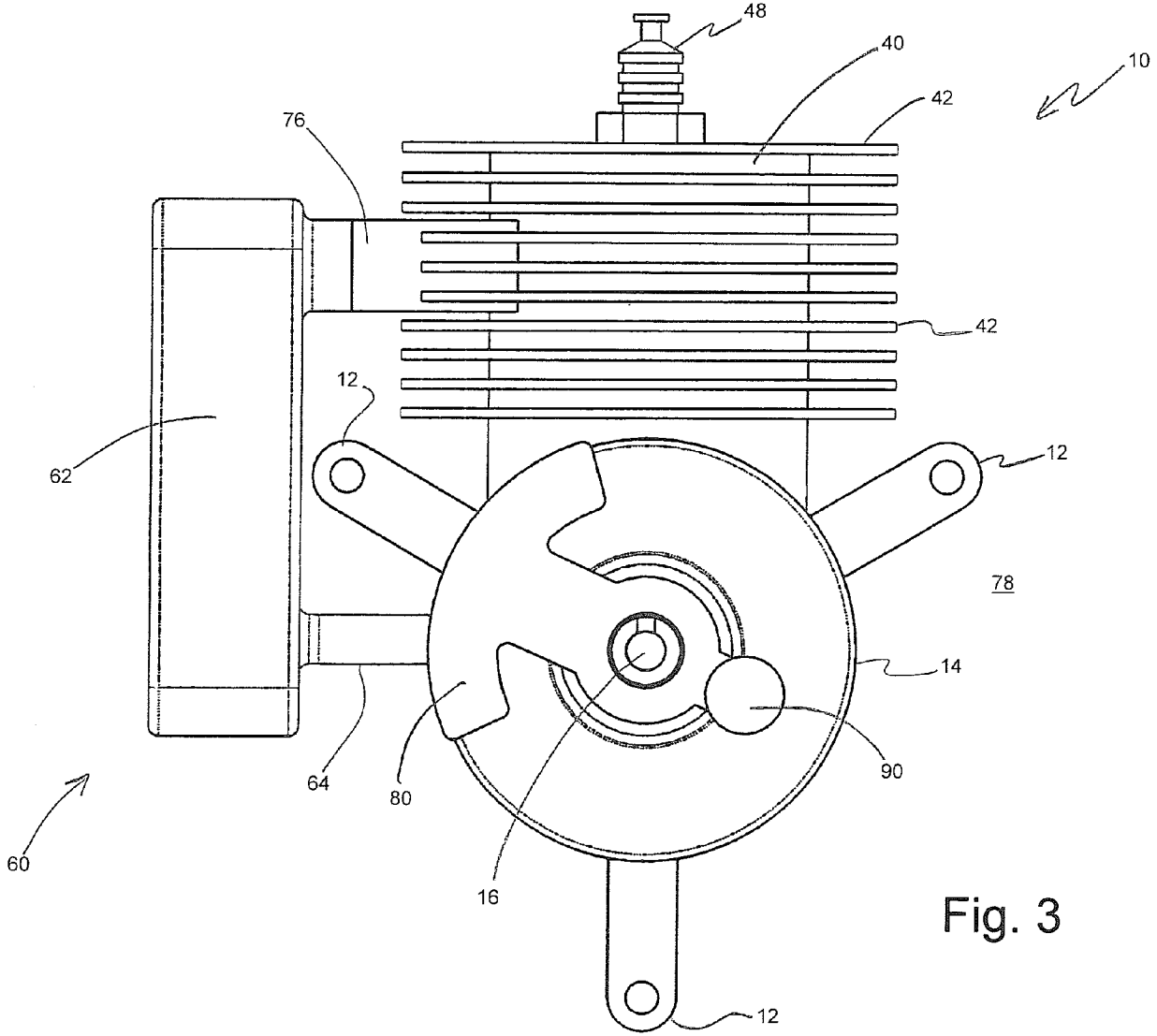
FIG. 3 is an end view of the engine of FIG. 1, with the exhaust system reflector being in the reflecting position of FIG. 2.
Figure 4:
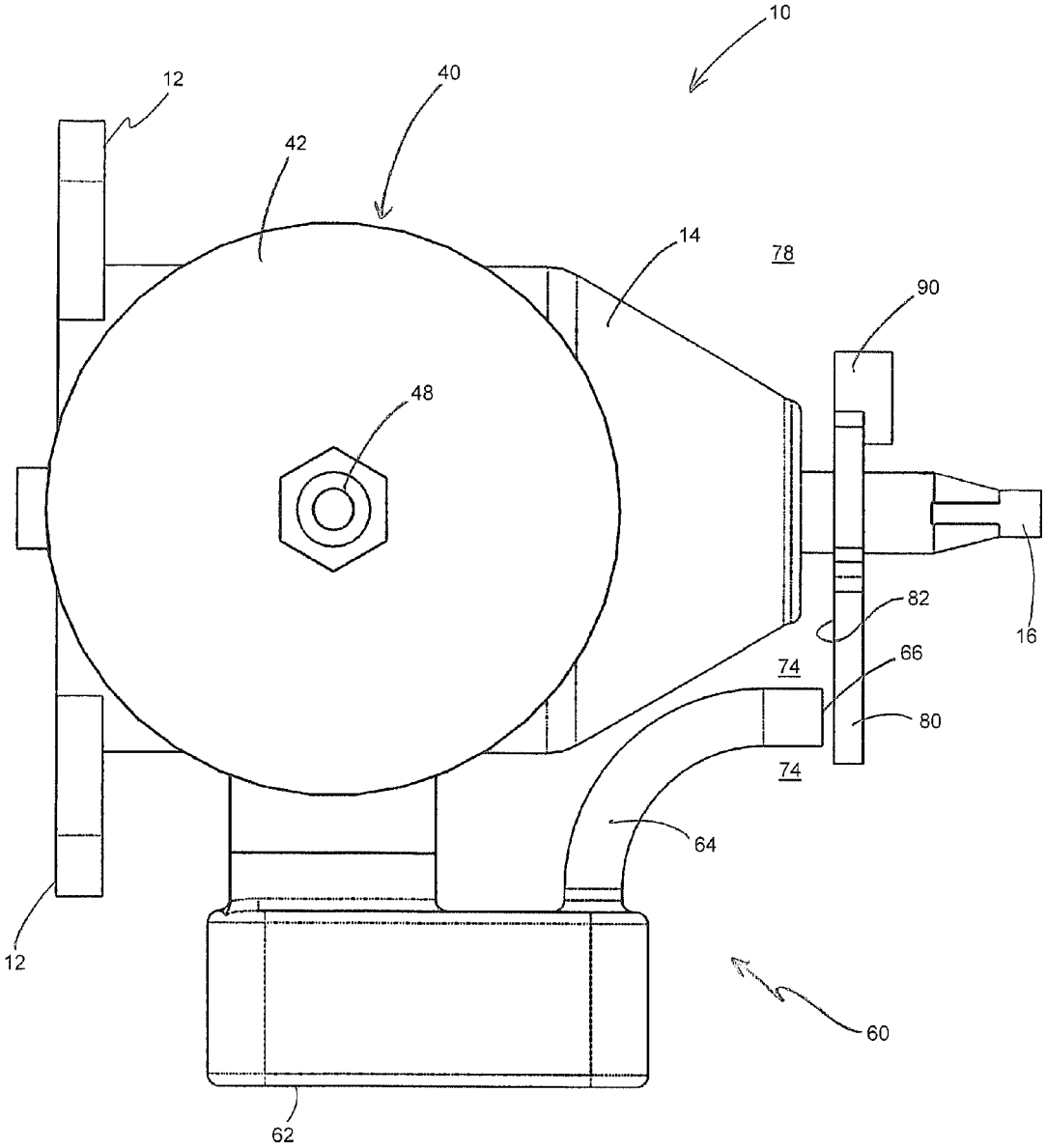
FIG. 4 is a top view of the engine of FIG. 1, with the exhaust system reflector being in a reflecting position for acoustic emissions discharged from the exhaust system.
Figure 5:
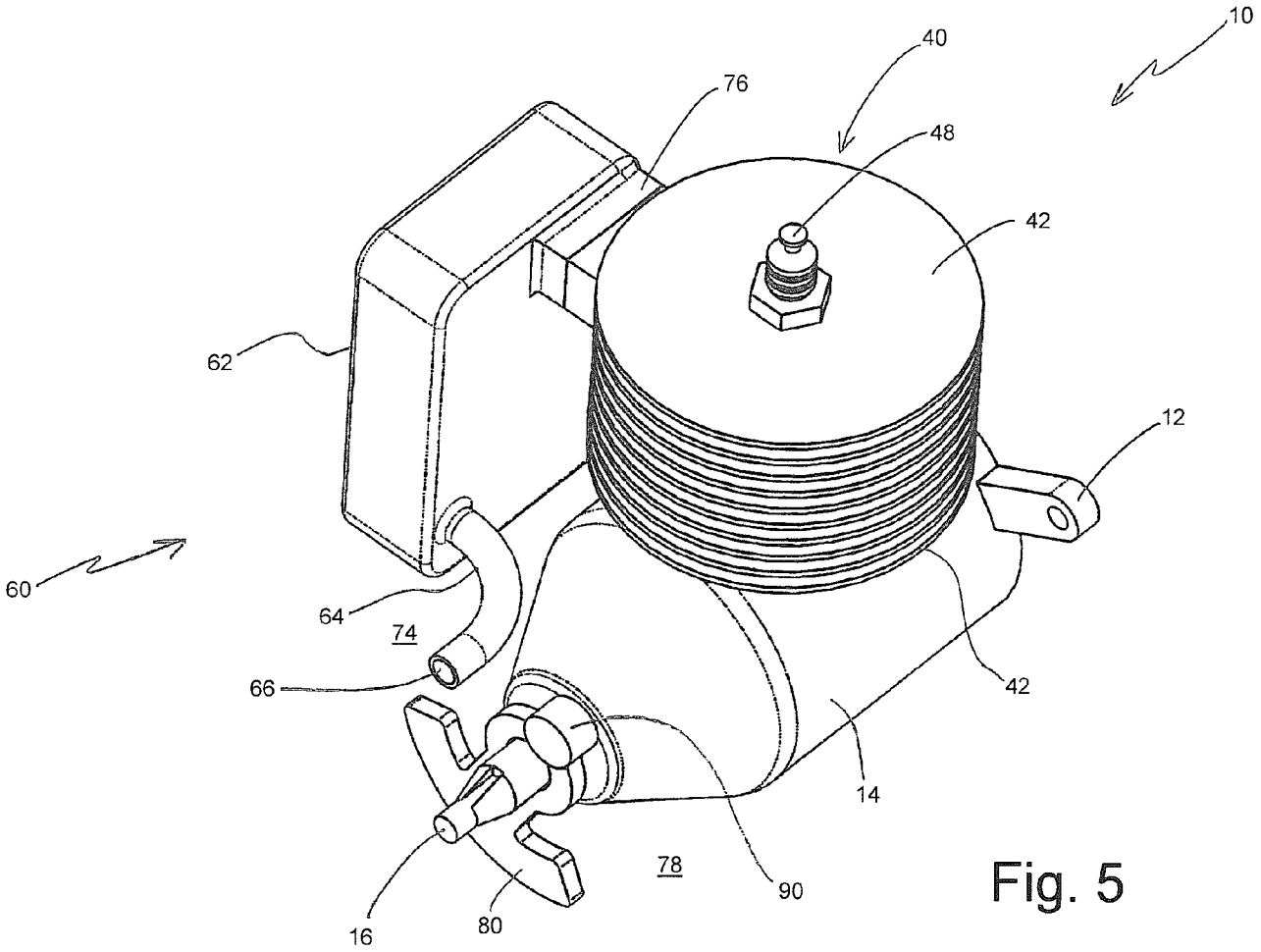
FIG. 5 is another perspective view of the engine of FIG. 1, with the exhaust system reflector being in another non-reflecting position for acoustic emissions discharged from the exhaust system.
Figure 6:
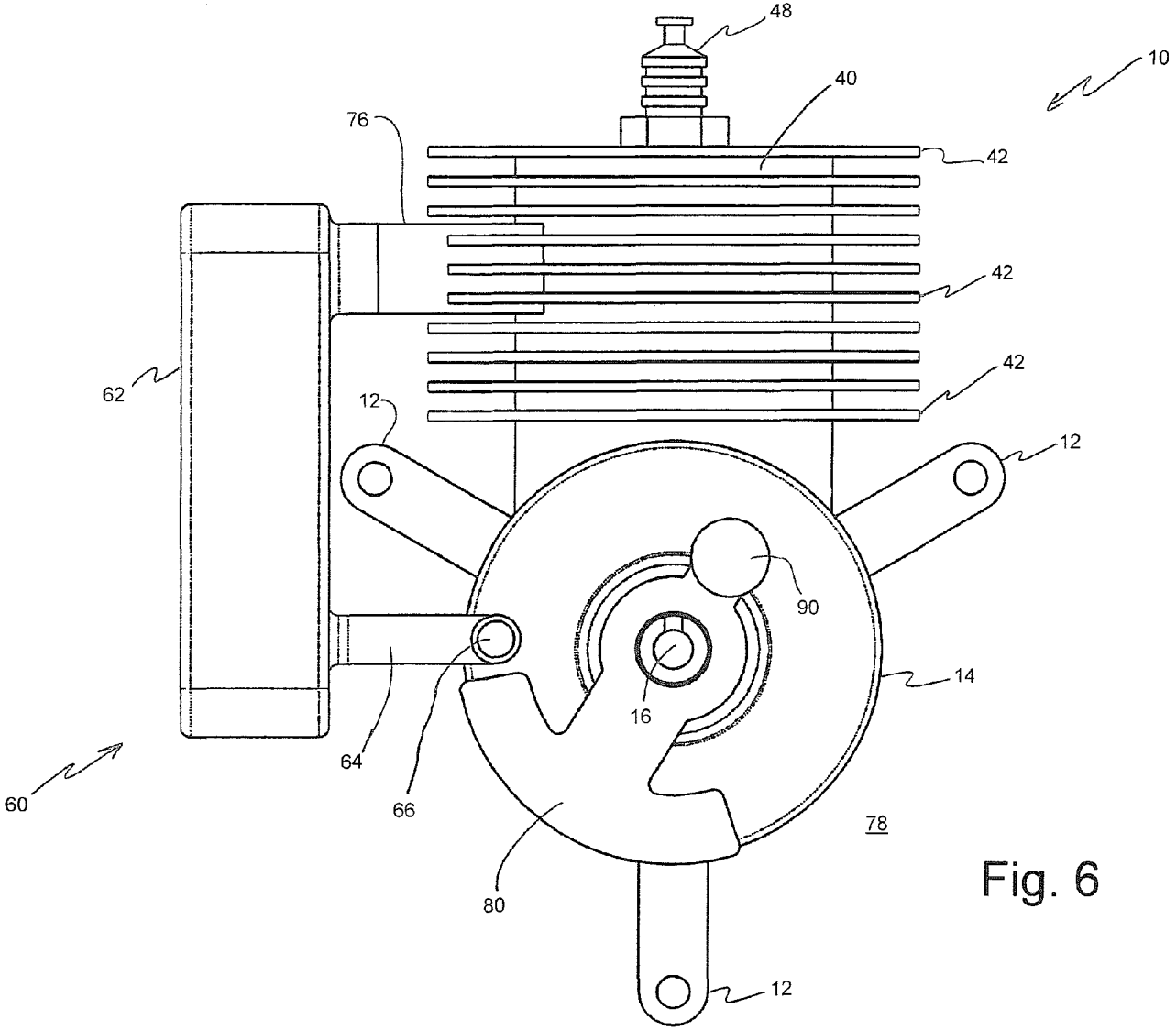
FIG. 6 is an end view of the engine of FIG. 1, with the exhaust system reflector being in the non-reflecting position of FIG. 5.
Figure 7:
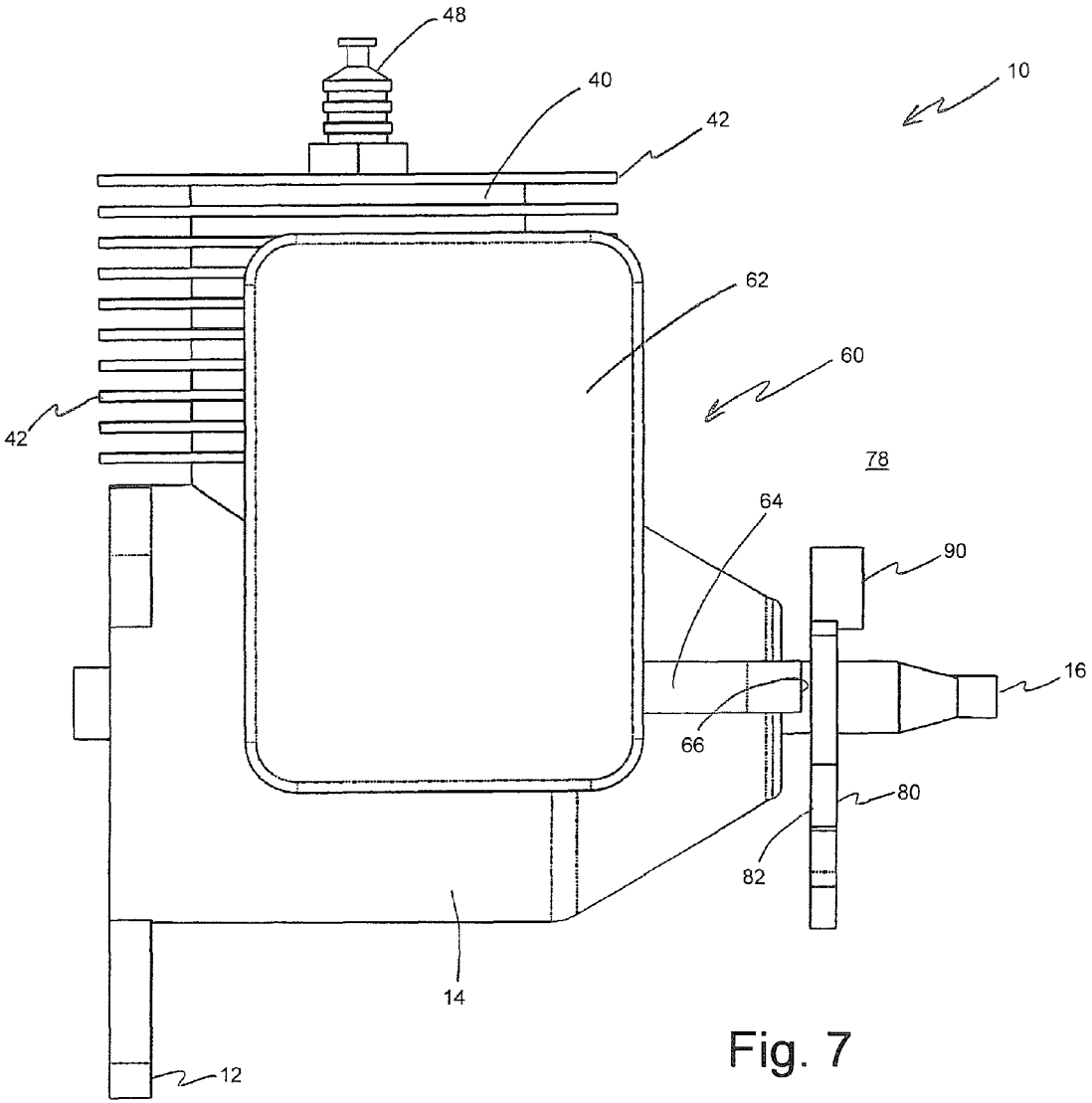
FIG. 7 is a side view of the engine of FIG. 1, illustrating the spacing between an exhaust discharge port and the exhaust system reflector.

FIG. 1 illustrates one rotational position of the crankshaft 16 and the reflector 80 where the reflector 80 and the open end 66 of the exhaust conduit 64 are not aligned—the reflector 80 is not positioned to reflect acoustic emissions back into the exhaust system 60 through the open end 66 of the exhaust conduit 64 (the reflector 80 should also not obstruct the bulk exhaust gas flow being discharged from the exhaust system 60 through the exhaust discharge port 66 when the reflector 60 is in the FIG. 1 position). FIGS. 2-4 each illustrate another rotational position of the crankshaft 16 and the reflector 80 where the reflector 80 and the open end 66 of the exhaust conduit 64 are aligned—the reflector 80 is now positioned to reflect acoustic emissions back into the exhaust system 60 through the open end 66 of the exhaust conduit 64 (at this point in time the bulk exhaust gas flow should not be at the reflector 80, so the reflector 80 should not be generating a back pressure in the exhaust system 60 with the reflector 80 being in the position shown in FIGS. 2-4). FIGS. 5-6 illustrate yet another rotational position of the crankshaft 16 and the reflector 80 where the reflector 80 and the open end 66 of the exhaust conduit 64 are once again no longer aligned—the reflector 80 is not positioned to reflect acoustic emissions back into the exhaust system 60 through the open end 66 of the exhaust conduit 64 (the reflector 80 should also not obstruct the bulk exhaust gas flow being discharged from the exhaust system 60 when the reflector 80 is in the position of FIGS. 5-6).

Figure 8A:
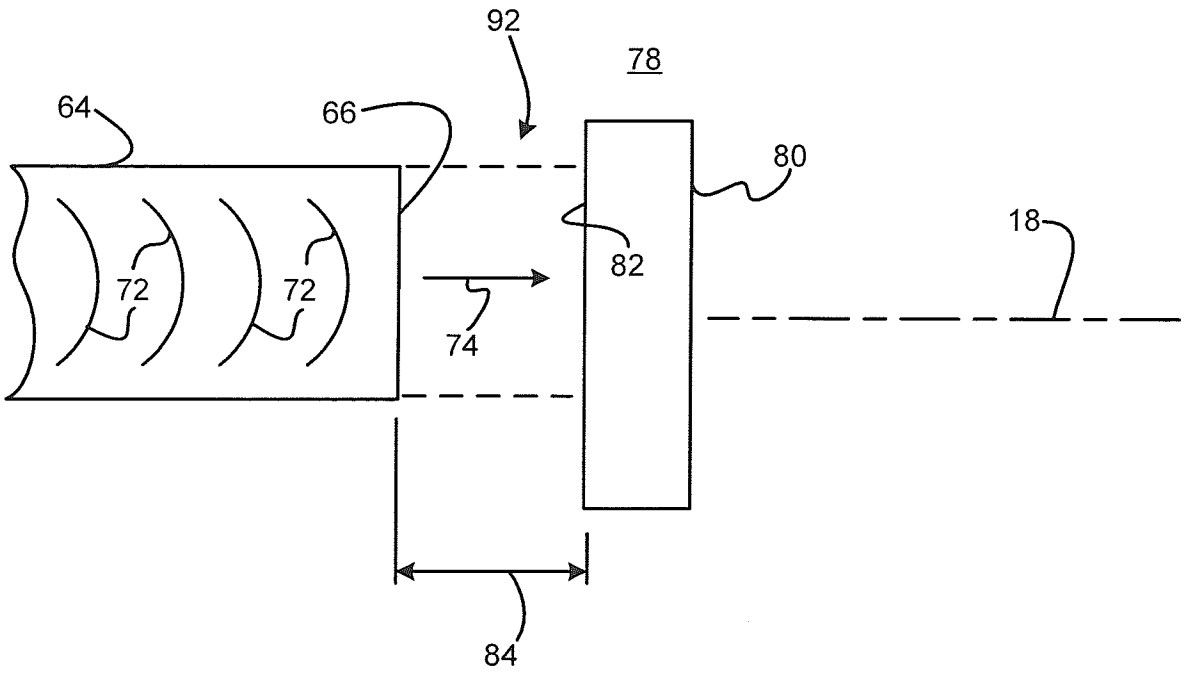
FIG. 8A is a side view schematic of the exhaust system reflector of the engine of FIG. 1, where the reflector is aligned with and spaced from an exhaust discharge port of the exhaust system.

FIG. 8A is a schematic that illustrates features regarding the position/orientation of the reflector 80 relative to the exhaust system 60 such that the reflector 80 is able to reflect acoustic emissions from the exhaust system 60 back into the exhaust system 60 (or obstruct such acoustic emissions from even leaving the exhaust system 60—discussed below in relation to FIG. 8C). For a frame of reference, the rotational axis 18 for the crankshaft 16 is illustrated (but not the crankshaft 16 itself). Waves or acoustic emissions 72 are shown in FIG. 8A, and advance along what may be characterized as a primary propagation vector 74 after exiting the open end 66 of the exhaust conduit 64. In the FIG. 8A configuration, the acoustic emissions 72 travel through the atmosphere 78 to reach the reflector 80 (again, as the reflector 80 is positioned within atmosphere 78).

A reflecting surface 82 of the reflector 80 (in the FIG. 8A position) may be characterized as being disposed at least substantially perpendicular to the above-noted primary propagation vector 74. Note that this reflecting surface 82 of the reflector 80 is also oriented orthogonal relative to the rotational axis 18 of the crankshaft 16 in the illustrated embodiment. When the reflector 80 is aligned with the open end 66 of the exhaust conduit 64, the primary propagation vector 74 intersects the reflecting surface 72 of the reflector 80. It should also be noted that there are no mechanical obstructions of any type between the open end 66 of the exhaust conduit 64 and the reflecting surface 82 of the reflector 80—the acoustic emissions 72 are not reflected in proceeding through the atmosphere 78 from the exhaust discharge port 66 to the reflecting surface 82 of the reflector 80. The acoustic emissions 72 may be characterized as proceeding through free space between the exhaust discharge port 66 and the reflector 80. Another characterization is that after exiting the exhaust system 60, the movement of the acoustic emissions 72 to the location of the reflector 80 is not constrained to proceed along a pre-defined path. Yet another characterization is that in the space between the open end 66 of the exhaust system 60 and the reflector 80, there are no radial boundaries to the flow of the exhaust—the exhaust does not flow through a containment structure of any type proceeding from the open end 66 of the exhaust conduit 64 to the location of the reflector 80 (when disposed in a reflecting position).

FIG. 8A also shows that a projection 92 from the open end 66 of the exhaust conduit 64 intersects the reflecting surface 82 of the reflector 80 when the reflector 80 is at least partially aligned with the open end 66 of the exhaust conduit 64. A perimeter of the projection 92 coincides with a perimeter of the open end 66 of the exhaust conduit 64. This projection 92 may also be referred to as the primary exhaust output path.

Figure 8B:
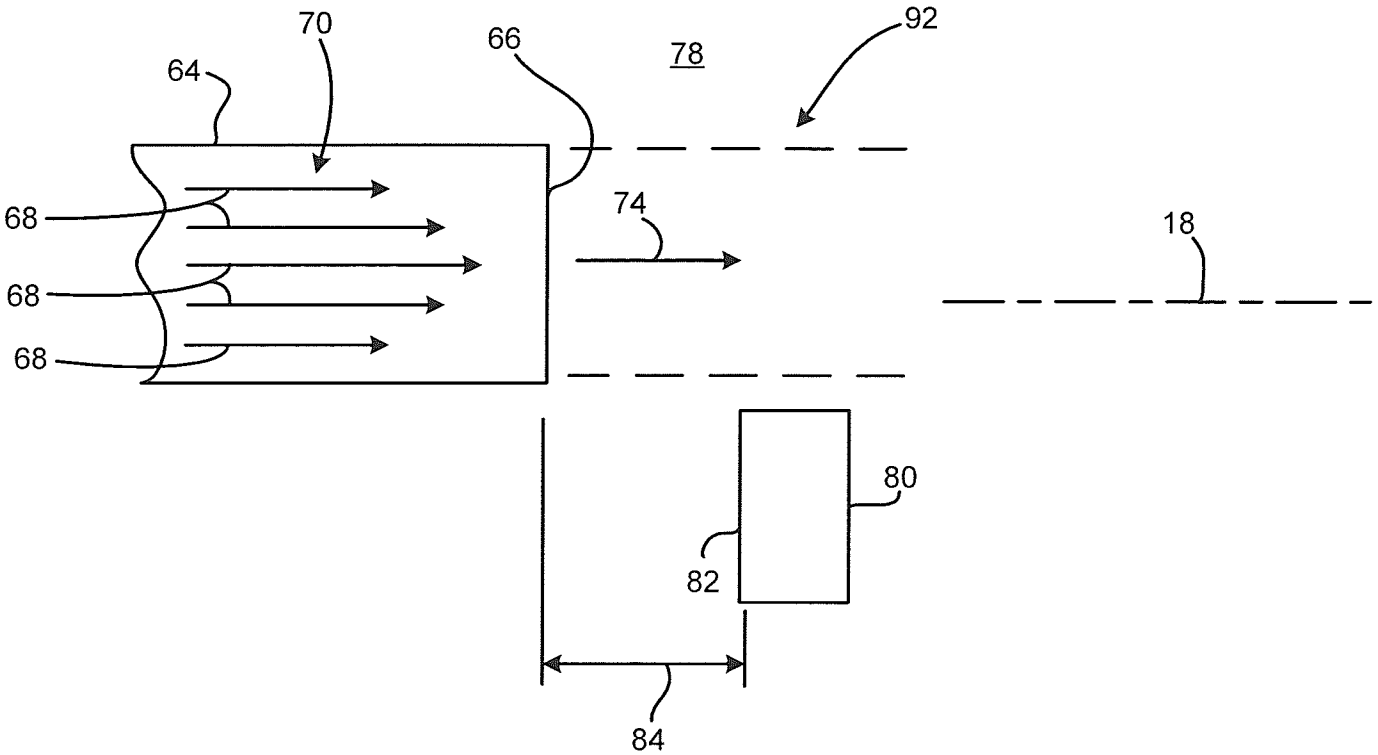
FIG. 8B is a side view schematic of the exhaust system reflector of the engine of FIG. 1, where the reflector is completely out of alignment with an exhaust discharge port of the exhaust system.

FIG. 8B illustrates the above-noted "other portion" of the exhaust from the exhaust system 60—the bulk exhaust gas flow 70. In this regard, the bulk exhaust gas flow 70 through the exhaust system 60 may be characterized as being collectively defined by a plurality of flow lines 68. The bulk exhaust gas flow 70 (like the acoustic emissions 72) may also be characterized as advancing along the above-noted primary propagation vector 74 after exiting the open end 66 of the exhaust conduit 64. Although the reflecting surface 82 of the reflector 80 is still oriented orthogonal to this primary propagation vector 74, the reflector 80 in the FIG. 8B position is completely out of alignment with the open end 66 of the exhaust conduit 64, and as such the reflector 80 does not obstruct the bulk exhaust gas flow 70 out of the exhaust system 60 (through the open end 66 of the exhaust conduit 64). As further illustrative of this point, the above-noted projection 92 of the open end 66 of the exhaust conduit 64 does not intersect the reflecting surface 82 of the reflector 80 when the reflector 80 is completely out of alignment with the open end 66 of the exhaust conduit 64.

Rotation of the crankshaft 16 moves the reflector 80 between a reflecting position and a non-reflecting position in relation to the acoustic emissions 72 that reach the exhaust discharge port 66 of the exhaust system 60. Initially and in the case of the embodiment illustrated in FIGS. 1-8B, the reflector 80 is actually spaced from the exhaust system 60—acoustic emissions 72 from the exhaust system 60 exit the open end 66 of the exhaust conduit 64 and proceed through the atmosphere 78 before encountering the reflector 80 (when disposed in a reflecting position). The acoustic emissions 72 exiting through the exhaust discharge port 66 of the exhaust system 60 may be characterized as proceeding unimpeded until reaching the location of the reflector 80—it may be that there are no reflections or mechanically-induced distortions of the acoustic emissions 72, after exiting the exhaust system 60 and prior to reaching the location of the reflector 80 (which again moves between reflecting and non-reflecting positions). When the reflector 80 is in a reflecting position, these acoustic emissions 72 are reflected by the reflector 80 (e.g., back into the exhaust system 60 via the open end 66 of the exhaust conduit 64, including back into the muffler 62). When the reflector 80 is in a non-reflecting position, bulk exhaust gas flow 70 discharged through the exhaust discharge port 66 of the exhaust system 60 proceeds unimpeded both up to and beyond the location of the reflector 80. As such, the configuration and movement of the reflector 80 should not generate any significant back pressure within the exhaust system 60 and/or the cylinder 40. Preferably the reflector 80 is never in the reflecting position when any bulk exhaust gas flow 70 reaches the reflector 80.

FIGS. 8A and 8B also illustrate that the reflecting surface 82 of the reflector 80 is positioned at least substantially adjacent to or in proximity to the open end 66 of the exhaust conduit 64. However, a small spacing 84 may in fact exist between the reflecting surface 82 of the reflector 80 and the open end 66 of the exhaust conduit 64. The actual magnitude of the spacing 84 may be selected such that: 1) the reflector 80 will reflect at least part of the exhaust (e.g., acoustic emissions) from the exhaust system 60 back into the exhaust system 60 (via the open end 66 of the exhaust conduit 64); and 2) the reflector 80 does not actually contact the exhaust conduit 64 as the reflector 80 is being rotated by the crankshaft 16 (e.g., accounting for thermal expansion and/or contraction during operation of the engine). In one embodiment, the spacing 84 is about 0.015 inch (measured along the maximum discharge velocity vector 72).

Figure 8C:
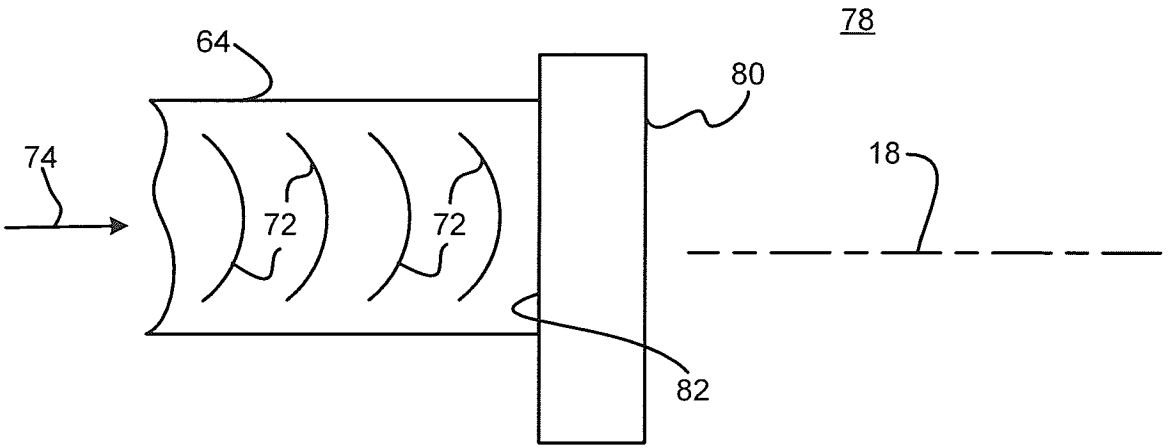
FIG. 8C is a side view schematic of an alternative position for the exhaust system reflector of the engine of FIG. 1, where the reflector is aligned with and abuts an exhaust discharge port of the exhaust system.

FIG. 8C illustrates a variation from that presented in FIG. 8A. Here and when the reflector 80 is in the reflecting position, the reflector 80 may actually contact the open end 66 of the exhaust conduit 64. As such, having the reflector 80 in the reflecting position in this case keeps acoustic emissions 72 (on their initial pass through the exhaust system 60) from actually leaving the exhaust system 60 through the exhaust discharge port 66.

Figure 8D:
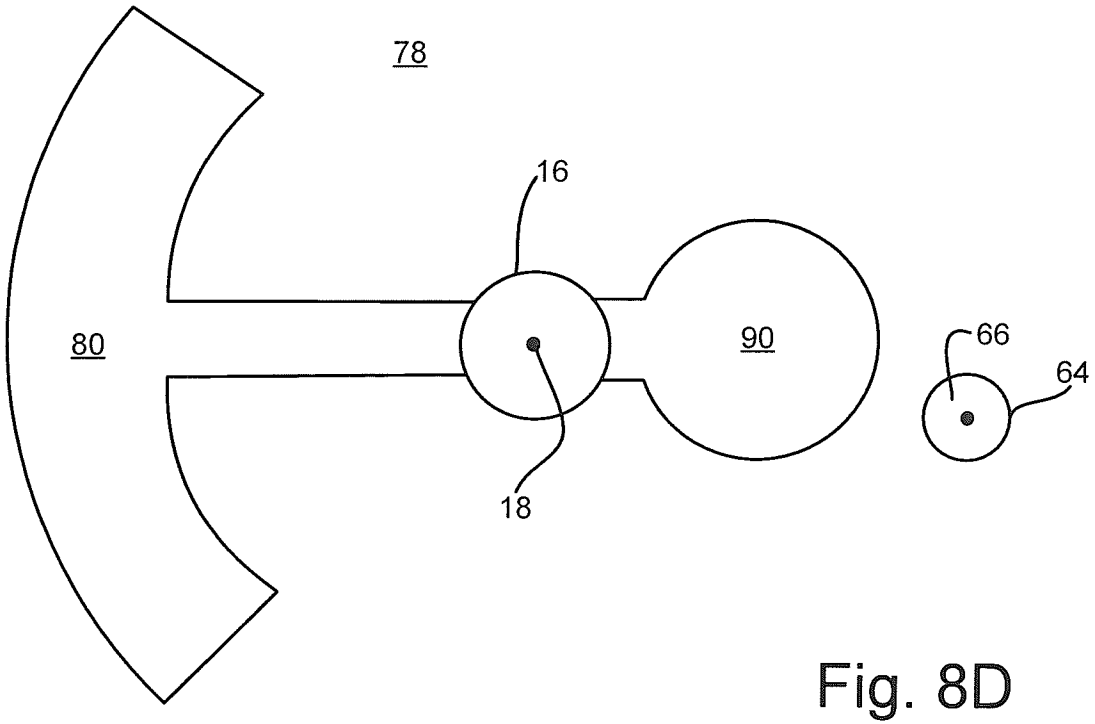
FIG. 8D is an end view schematic of the exhaust system reflector and associated counterweight from the engine of FIG. 1, with the exhaust system reflector being in a non-reflecting position for acoustic emissions discharged from the exhaust system, and illustrating the position of the counterweight in relation to the exhaust discharge port.

The engine 10 again may include a counterweight 90 for rotational balancing of the crankshaft 16 (in view of the reflector 80 extending therefrom). FIG. 8D shows the above-discussed relative positional relationship of the reflector 80 and counterweight 90. FIG. 8D also shows that the counterweight 90 is incorporated so that the counterweight 90 is not aligned with the output end 66 of the exhaust conduit 64 throughout the full 360° of rotation of the crankshaft 16 and the counterweight 90. At no time is the counterweight 90 positioned to reflect any portion of the exhaust from the exhaust system 60 back into the exhaust system 60 (through the open end 66 of the exhaust conduit 64).

Figure 9:
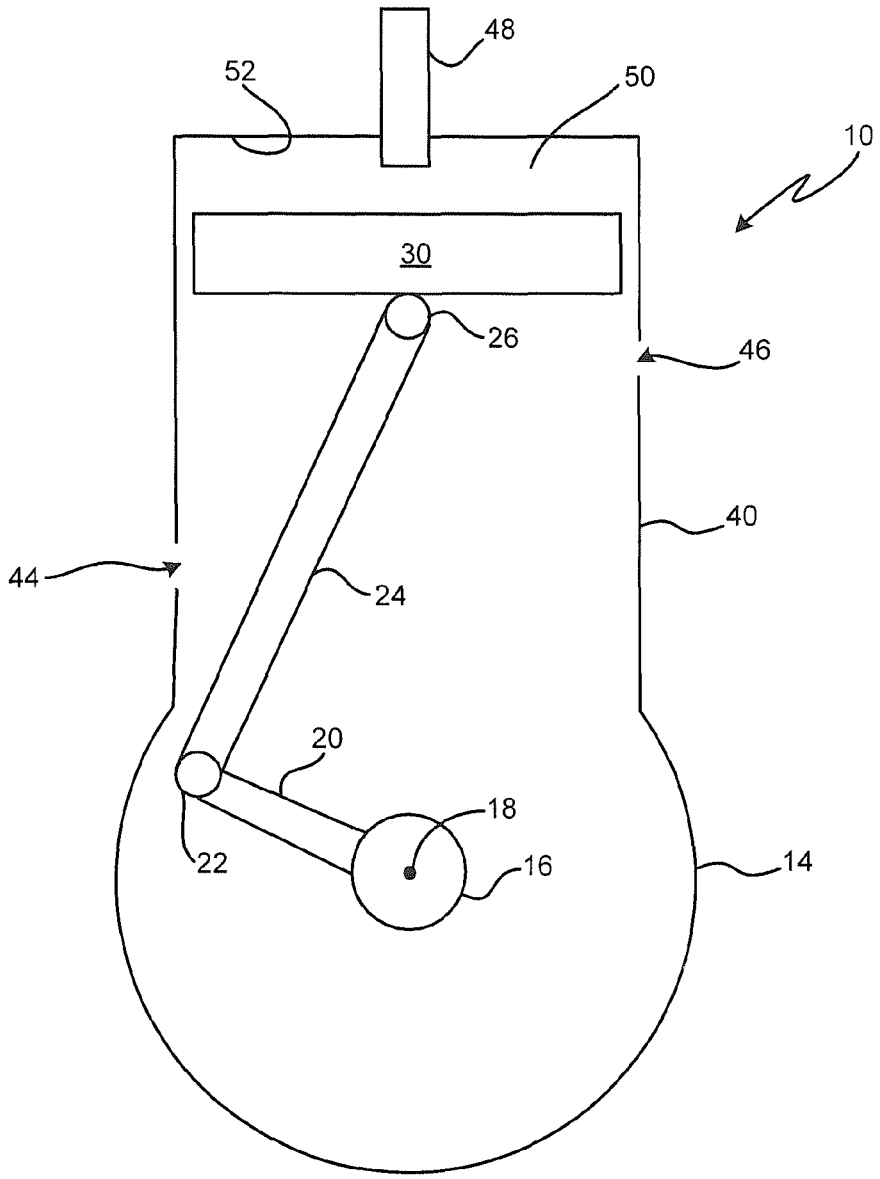
FIG. 9 is a schematic of one configuration of a cylinder for the engine of FIG. 1, along with a corresponding piston.

The engine 10 may use one or more cylinders 40, and furthermore may be of a two-cycle configuration (although the arrangement disclosed herein with regard to an exhaust system reflector 80 may be used/adapted for a four-cycle configuration as well). A schematic of a representative cylinder 40 for the engine 10 of FIGS. 1-7 is presented in FIG. 9, and is of a two-cycle configuration. A piston 30 reciprocates within the cylinder 40. In this regard, a connecting rod 20 is appropriately fixed relative to the crankshaft 16 and extends to a pivot 22. A piston rod 24 extends from the pivot 22 to another pivot 26 associated with the piston 30. As such, rotation of the crankshaft 16 about its rotational axis 18 will drive the piston 30 up and down in alternating fashion (in the view shown in FIG. 9).

The cylinder 40 includes an intake port 44 and an exhaust port 46. One or more valves may be associated with one or more of the ports 44, 46. An air/fuel mixture may be drawn into the engine case 14 during movement of the piston 30 from a bottom dead center position toward a top dead center position (after the piston 30 passes the intake port 44). This movement of the piston 30 also compresses the air/fuel mixture that is contained within the combustion chamber 50 (located between the piston 30 and a closed end 52 of the cylinder 40, and directed into the chamber 50 through the intake port 44/engine case 14). At some point in time during the movement of the piston 30 toward its top dead center position, the piston 30 will isolate the exhaust port 46 from the combustion chamber 50.

When the piston 30 reaches (or is at least near) its top dead center position, the spark plug 48 ignites the air/fuel mixture within the combustion chamber 50, which drives the piston 30 from its top dead center position back toward its bottom dead center position. At some point in time during the movement of the piston 30 toward its bottom dead center position, the exhaust port 46 will be exposed to the combustion chamber 50 to allow a flow of exhaust out of the combustion chamber 50, through the exhaust port 46, and into the above-discussed exhaust system 60 (e.g., into/through the exhaust header 76, and then into/through the muffler 62, and then into/through the exhaust conduit 64). Movement of the piston 30 toward its bottom dead center position will at some point in time compress the air/fuel mixture that has previously entered the engine case 14 through the intake port 44.

Acoustic emissions 72 and bulk exhaust gas flow 70 will be discharged from the cylinder 40 on each revolution of the crankshaft 16. During one part of the revolution of the crankshaft 16, the reflector 80 will be in position to obstruct/reflect the acoustic emissions 72 from a given discharge from the cylinder 40 (their initial pass through the exhaust system 60) (e.g., FIGS. 2-4). During the remainder of the revolution of the crankshaft 16, the reflector 80 will be in position so as to not obstruct the corresponding bulk exhaust gas flow 70 from this same discharge from the cylinder 40. It should be appreciated that when the reflector 80 is in a non-reflecting position (e.g., FIGS. 1, 5, and 6) acoustic emissions 72, that have already been attenuated in at least some respect by the reflector 80, may in fact proceed past the reflector 80.

Figure 10:
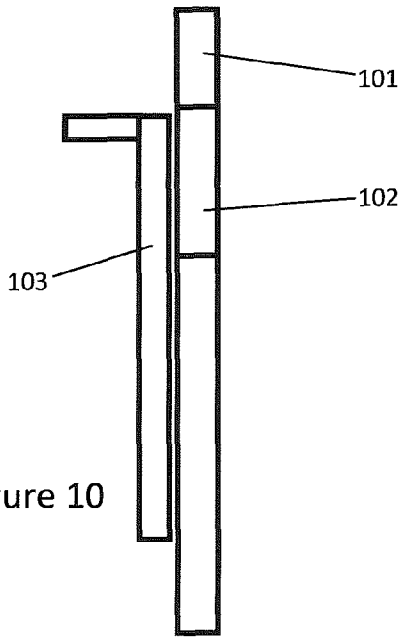
FIG. 10 is a schematic of a portion of a piston and cylinder wall.

FIG. 10 presents a schematic of a section of a piston-cylinder wall including a cylinder wall 101, an exhaust port window or exhaust port 102, and a piston 103. As the piston 103 moves along the cylinder wall 101, the exhaust port 102 is repeatedly uncovered/opened and covered/closed. As a result of the compression or upstroke phase by the piston 103 and the intended combustion event in the engine cylinder, the piston 103 is forcibly pushed from the crankshaft position known as top-dead-center through the expansion or down stroke phase in response to the high pressure combustion product/exhaust gases retained in the cylinder. At a known crankshaft position in the expansion or down stroke of the piston 103, the exhaust port 102 is uncovered or opened. The uncovering or opening of the exhaust port or exhaust valve 102 in the down stroke releases an acoustic wave into the exhaust system consisting of components such as a header and muffler. In the exhaust system, the acoustic wave may be subjected to conduits, chambers, and packing to absorb and create reflected waves with the objective of modifying the acoustic signature of the wave front exiting the muffler stinger or tail-pipe.

By reflecting the acoustic wave that initially exits the exhaust system stinger or tail-pipe back through an existing exhaust system, additional acoustic wave interactions with the existing packing and chambers, including destructive interference, serves to further modify the acoustic signature of the exhaust system.

To accomplish a timed reflector, the crankshaft angle (effectively a representation of time) corresponding to the arrival of the exhaust port pressure wave at the exit of the muffler stinger is evaluated. Crankshaft angle of the exhaust port pressure wave arrival at the muffler stinger is calculated using the exhaust system length measured from the exhaust port 102 to the exit of the stinger; velocity of the exhaust port pressure wave; and rotational speed of the engine.

Timing the reflector to be in position when the exhaust port acoustic wave exits the muffler stinger is important to achieving the desired acoustic signature. Of importance to achieving acoustic modification is the crankshaft position of the opening of the exhaust port 102 and timing the reflector to be in position at the appropriate crankshaft position. Examples of a nominal timing computation are presented in Table 1 as follows:

TABLE 1

Crankshaft Rotation And Transit of Exhaust Port Pressure Wave

| Engine Speed | | Distance pressure wave travels per deg of crankshaft | Crankshaft rotation, degrees, during transit of pressure wave from exhaust port window to exit of stinger, L | | |
|---|---|---|---|---|---|
| | | | L = 26 in | L = 30 in | L = 34 in |
| revolution/min | revolution/sec | rotation in/deg | angle deg | angle deg | angle deg |
| 3200 | 53.3 | 1.06 | 24.5 | 28.2 | 32.0 |
| 7200 | 120 | 0.47 | 55.1 | 63.5 | 72.0 |

Figure 11:
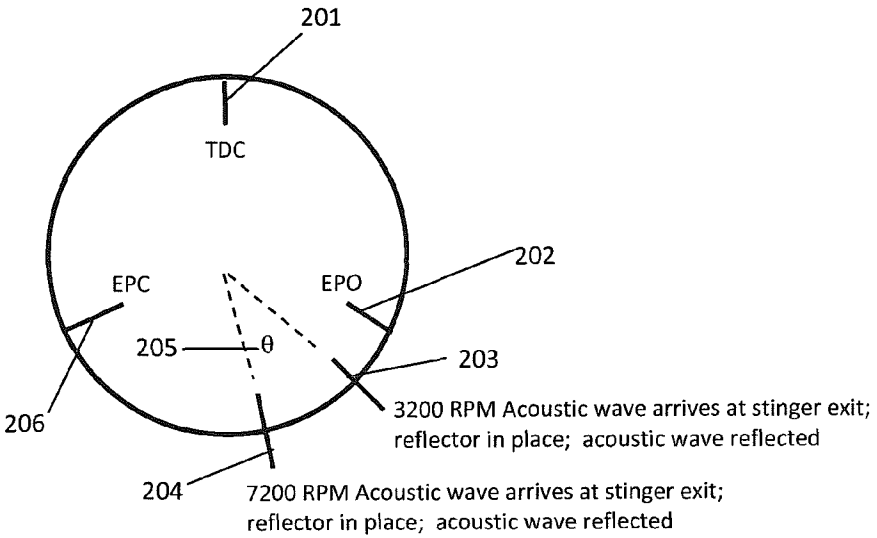
FIG. 11 is a timing schematic for an exhaust system reflector.

Exhaust Port Open at 110 deg after Top Dead Center
Exhaust Port Close at 110 deg before Top Dead Center
Acoustic wave (sound wave) speed, estimate = 1700 ft/sec A representation of the above-noted timing discussed above is shown in FIG. 11. Consider for example the desire to modify the acoustic signature of a single cylinder engine between 3200 rev/min and 7200 rev/min; exhaust system length of 30 in; the exhaust port 102 opens 202 and thereby initiates the exhaust port acoustic wave at 110 degrees from engine top-dead-center 201; exhaust port acoustic wave speed of 1,700 ft/sec; the leading section of the reflector is centered at approximately 135 deg and identified by reference numeral 203 (which equals the sum of 110 deg crankshaft angle of the exhaust port opening and the 25 degree crankshaft angle (i.e., time for the 3200 rev/min exhaust port acoustic wave to travel through the exhaust system)) from top-dead-center 201, and the trailing section of the reflector is centered at approximately 175 deg (reference numeral 204, which equals the sum of 110 deg crankshaft angle exhaust port opening and the 7200 rev/min 65 degree crankshaft angle (i.e., time for the 7200 rev/min exhaust port acoustic wave to travel through the exhaust system) from top-dead-center 201 spans the estimated crankshaft angles corresponding to the initial arrival of the exhaust port acoustic wave at the stinger exit for engine speeds between 3200 rev/min and 7200 rev/min). The nominal angle swept by the reflector, theta 205, is a relatively small portion of the engine cycle and does not include the angular position of exhaust port close 206. For optimal effectiveness, the reflector must fully cover the stinger exit cross-sectional area. Hence, the leading and trailing sections of the reflector should completely cover the cross sectional area of the stinger exit.

In addition to timing of the reflector deployment, the nominal physical dimensions of the reflector are guided by the calculation results presented in Table 1 above as well. Returning to the previous example of an single cylinder engine, having an exhaust system length of 30 inches; desired additional acoustic signature modification between 3200 rev/min and 7200 rev/min engine speed; the nominal angular sweep 205 of the reflector is described by the difference between the crankshaft angular position when the exhaust port acoustic wave arrives at the stinger exit at the highest engine speed of interest and the crankshaft angular position when the exhaust port acoustic wave arrives at the stinger exit at the lowest engine speed of interest. For the example under consideration, the included angle 205 of the reflector of approximately 35 degrees is a starting point of the angular dimension for sizing the timed reflector. For optimal effectiveness, the reflector should fully cover the stinger exit cross-sectional area as noted. Hence, the leading and trailing sections of the reflector should completely cover the cross-sectional area of the stinger exit and should in fact extend beyond the calculated estimate of angle 205. As should be recognized by those of skill in the art, the sizing computations presented in Table 1 utilize certain assumptions and are intended to provide a starting point for the sizing of the reflector. It is well recognized in the art of acoustic modulating devices, including mufflers and silencers, that additional adjustments or tuning may be required to achieving the desired acoustic signature.

Figure 13:
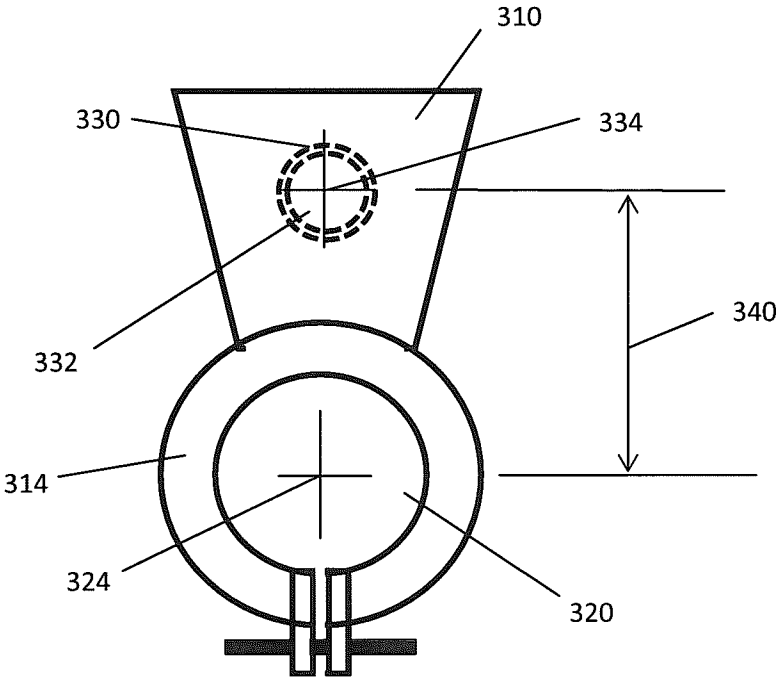
FIG. 13 shows the exhaust system reflector of FIG. 12 in relation to an open end of an exhaust conduit for the exhaust system.
Figure 12:
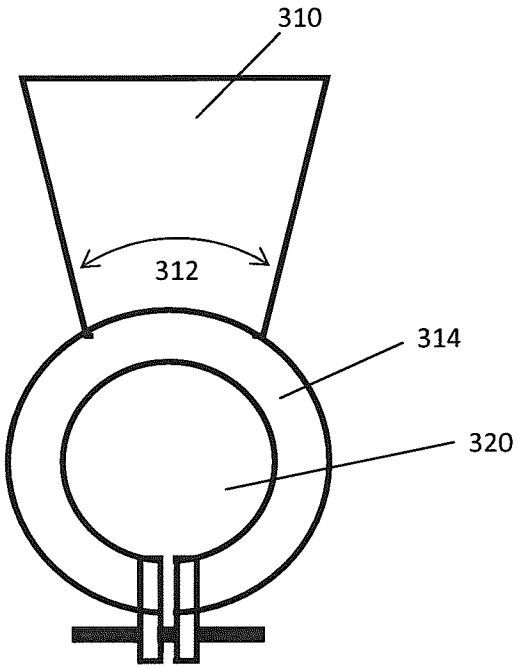
FIG. 12 is a schematic of an embodiment of an exhaust system reflector for a single-cylinder engine.
Figure 15:
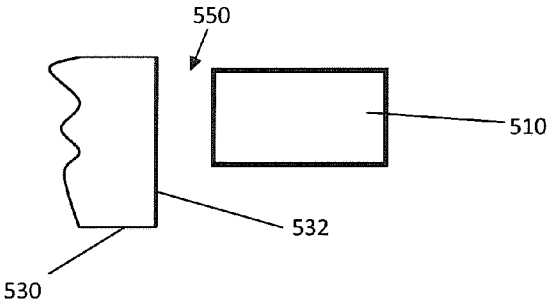
FIG. 15 is a schematic that illustrates a clearance between an open end of an exhaust system conduit and an exhaust system reflector.

FIGS. 12 and 13 show a reflector 310 attached to and rotatable with a crankshaft 320. The length dimension of the reflector 310 (how far the reflector 310 extends from the crankshaft 320) depends on parameters including but not limited to the distance from the centerline 324 and orientation of the crankshaft 320 to the centerline 334 and diameter of the exhaust system stinger 330 at its open end 332. The reflector 310 may be oriented such that is reflecting surface is disposed at least substantially perpendicular to the exhaust path. Again, preferably the reflector 310 is timed such that it reflects the acoustic portion of the exhaust back into the exhaust system, but does not obstruct any substantial portion of the bulk exhaust gas flow (e.g., which would generate back pressure in the exhaust system and an engine cylinder(s)). Such a back pressure will likely adversely affect performance of the engine. Although reflecting the acoustic portion of the exhaust back into the exhaust system should not significantly impact engine performance, a resonator could be included in the exhaust system (e.g., within the muffler) to further accommodate acoustic wave destructive interference. Such a reflected wave resonator could be configured so as to not function as a resonator for the acoustic waves originating at the engine exhaust port (e.g., 102).

Figure 14:
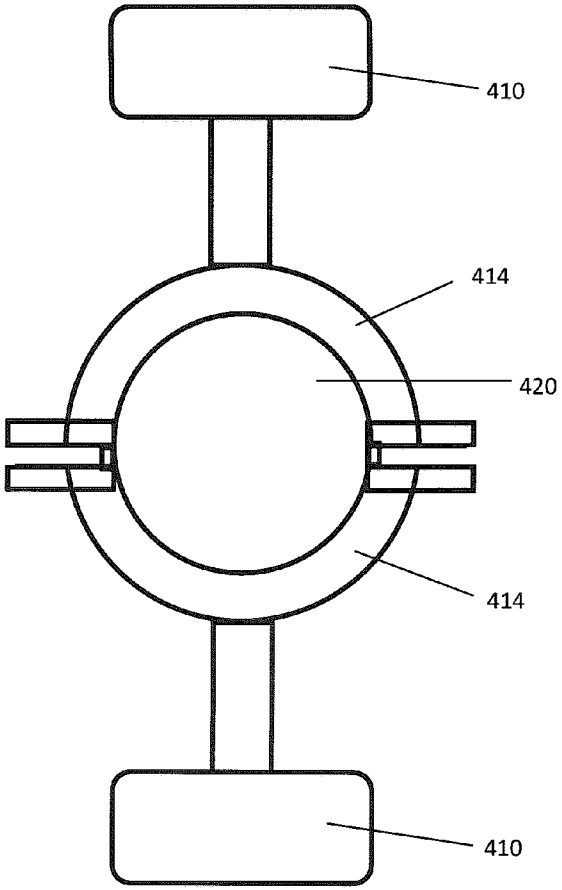
FIG. 14 is a schematic of an embodiment of an exhaust system reflector for a dual-cylinder engine.

FIGS. 12/13 and FIG. 14 are schematics of one and two cylinder timed reflectors 310, 410, respectively. Shared attributes of the two exemplary reflectors 310, 410 are timed reflector surfaces and crankshaft connection 314 and 414. Crankshaft connection is not limited to post manufacture installation using a clamshell or similar clamping attachment configuration. Inclusion of the timed reflector 310, 410 can also be accomplished as an inherent attribute of the crankshaft design. Inclusion of the reflector 310, 410 directly in the crankshaft design eliminates the need for post assembly clocking/positioning of the reflector 310, 410 with respect to top-dead-center to achieve the desired acoustic modification. Consideration must be given to crankshaft balance when including the reflector 310, 410 either as a removable or integral device. Specifically, to maintain the balance of the rotating crankshaft 320, 420, the need for inclusion of a counterweight must be evaluated. The simplicity of the reflector design lends itself to ready incorporation of counterweight as needed.

FIG. 6 illustrates an additional consideration in the design of a timed reflector in accordance with the foregoing: clearance 650 between the open end 532 of the stinger 530 and the reflecting surface of the timed reflector 410. To allow for thermal expansion of the components, it has been determined that 0.015 inches is an initial reasonable clearance value.

Those of ordinary skill in the art will recognized that physical configuration, spatial orientation, dimensions of the timed reflector is not prescribed by the description provided herein nor limited to the exemplary configurations. Additionally, those of ordinary skill in the art will recognize that there are many choices of construction material of the timed reflector and that the reflector/valve may incorporate surface texture, treatments, perforations and the like to achieve the desired characteristics of the reflected pressure wave and hence the desired acoustic signature.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. An engine, comprising:

a first cylinder;

a first piston disposed within said first cylinder;

a rotatable crankshaft interconnected with said first piston;

an exhaust system fluidly connected with said first cylinder and comprising an exhaust discharge port; and a reflector extending from and rotated by said crankshaft, wherein said reflector is positioned within atmosphere, and wherein said reflector is disposable into alignment with and completely out of alignment with said exhaust discharge port by rotation of said crankshaft.

2. The engine of claim 1, wherein said reflector obstructs acoustic emissions that progress through said exhaust system when said reflector is aligned with said exhaust discharge port.

3. The engine of claim 2, wherein said reflector does not obstruct bulk exhaust gas flow out of said exhaust discharge port when said reflector is completely out of alignment with said exhaust discharge port.

4. The engine of claim 2, wherein a bulk exhaust gas flow from said cylinder does not reach said reflector when said reflector is aligned with said exhaust discharge port.

5. The engine of claim 1, wherein said reflector does not obstruct bulk exhaust gas flow out of said exhaust discharge port when said reflector is completely out of alignment with said exhaust discharge port.

6. The engine of claim 1, wherein a projection extending from said exhaust discharge port intersects said reflector when said reflector is aligned with said exhaust discharge port, and wherein a perimeter of said projection coincides with a perimeter of said exhaust port.

7. The engine of claim 6, wherein said projection does not intersect said reflector when said reflector is completely out of alignment with said exhaust discharge port.

8. The engine of claim 6, wherein said acoustic emissions proceed unimpeded from said exhaust discharge port to said reflector.

9. The engine of claim 1, wherein a projection extending from said exhaust discharge port does not intersect said reflector when said reflector is completely out of alignment with said exhaust discharge port, and wherein a perimeter of said projection coincides with a perimeter of said exhaust discharge port.

10. The engine of claim 1, a bulk exhaust gas flow from said cylinder is discharged through said exhaust discharge port along a primary propagation vector, wherein said primary propagation vector intersects said reflector when said reflector is aligned with said exhaust discharge port, and wherein said primary propagation vector does not intersect said reflector when said reflector is completely out of alignment with said exhaust discharge port.

11. The engine of claim 10, wherein a reflecting surface of said reflector is oriented orthogonal to said primary propagation vector.

12. The engine of claim 1, wherein a reflecting surface of said reflector is oriented orthogonal to a rotational axis of said crankshaft.

13. The engine of claim 1, wherein said reflector is positioned adjacent to, but spaced from, said exhaust discharge port when said reflector is aligned with said exhaust discharge port.

14. The engine of claim 13, wherein said reflector is spaced about 0.015 inches from said exhaust discharge port when said reflector is aligned with said exhaust discharge port.

15. The engine of claim 1, wherein said reflector is disposed in abutting relation to said exhaust discharge port when said reflector is aligned with said exhaust discharge port.

16. The engine of claim 15, wherein said counterweight and said reflector are disposed at the same location along a common rotational axis.

17. The engine of claim 16, wherein said counterweight is at all times disposed completely out of alignment with said exhaust discharge port.

18. The engine of claim 1, wherein said exhaust system comprises a muffler and an exhaust conduit extending from said muffler, wherein said exhaust discharge port is defined by an open end of said exhaust conduit.

19. The engine of claim 1, further comprising:

a counterweight extending from and rotated by said crankshaft.

20. The engine of claim 19, wherein said counterweight is at all times disposed completely out of alignment with said exhaust discharge port.

* * * * *